United States Patent [19]

Kentosh

[11] 4,317,474

[45] Mar. 2, 1982

[54] MOORING TERMINAL FOR TRANSFERRING DIFFICULT CARGO

[75] Inventor: James M. Kentosh, Los Angeles, Calif.

[73] Assignee: Amtel, Inc., Providence, R.I.

[21] Appl. No.: 126,308

[22] Filed: Mar. 3, 1980

[51] Int. Cl.[3] ..... B65B 3/04

[52] U.S. Cl. ..... 141/1; 141/279; 141/387; 137/615

[58] Field of Search ..... 141/279, 387, 388; 137/236, 615

[56] References Cited

U.S. PATENT DOCUMENTS 4,090,538 5/1978 Kotcharian ..... 141/387

*Primary Examiner*—Houston S. Bell

*Attorney, Agent, or Firm*—Freilich, Hornbaker, Wasserman, Rosen & Fernandez

[57] ABSTRACT

A mooring and cargo transfer terminal is described, for use in transferring a fluid such as LNG (liquified natural gas) which is supercooled and therefore likely to cause severe icing of pipes and joints. The terminal includes a table support in the form of a tower extending from a base at the sea floor up to the sea surface, and a table device rotatable about a vertical axis at the top of the table support. The table device carries a pair of fenders that can press directly against the side of a ship, hawser couplings for tying the table device to a set of hawsers that hold it tightly against the ship, and one or more loading arms which can extend beyond the table device to connect to an LNG coupling on the ship. A pipe carries LNG from an underwater pipeline up to a fluid swivel at the top of the table support, and the rotatable portion of the fluid swivel connects to the loading arms to deliver the LNG thereto. The direct abutment of the rotatable table with the side of a ship near the bow thereof, enables loading arms of minimal length to be utilized to carry the LNG to the ship.

10 Claims, 4 Drawing Figures

MOORING TERMINAL FOR TRANSFERRING DIFFICULT CARGO

BACKGROUND OF THE INVENTION

Offshore terminals for mooring a tanker for transferring fluid between the ship and an underwater pipeline, are available in a wide variety of configurations. However, where a supercooled liquified gas such as LNG (liquified natural gas) must be transferred, a large number of such systems are not usable. Ice tends to form around any pipes that carry LNG, even those above water, and otherwise flexible hoses tend to become hardened because of the extremely low temperature. The use of long hoses that lie in the water for pick up by ships is impractical. Underwater swivel units are usually impractical, because LNG molecules are small and therefore readily leak, and underwater swivel units tend to freeze into an unmovable condition unless costly precautions are taken. While loading arms and hoses are available for carrying LNG, they are normally useable in only moderate to short lengths, because they become unweildy when very long.

Despite the difficulties involved in transferring LNG through offshore terminals, such terminals have considerable advantages over fixed docks. An important advantage is that offshore terminals can be placed far enough from the shore to avoid dangers to homes and other property near the shore in the event of an accident. In addition, an offshore terminal can avoid the expense of a complete port facility in remote areas, and can enable the transference of LNG even in rough weather. An offshore terminal of relatively modest cost would therefore be of considerable advantage in the transport of supercooled liquids such as LNG.

SUMMARY OF THE INVENTION

In accordance with one embodiment of the present invention, a mooring and cargo transfer system is provided for transferring a difficult fluid between an underwater conduit and a vessel, which minimizes the length of above-water exposed and unsupported conduit which extend to the vessel. The system includes a tower table support which extends from the sea floor up to substantially the sea surface, and a table device which can rotate about a vertical axis about the table support. The table device includes a fender apparatus that can directly engage the side of a ship, and a hawser coupling apparatus which can hold a hawser or other tension member that ties the table device tightly against the side of the ship. The abutment of the table device to the ship, enables a loading arm of only moderate length to be utilized on the table device to reach beyond it and connect to the ship to transfer LNG to other difficult-to-handle fluid between the table device and ship.

The conduit for carrying LNG between an underwater line and a loading arm on the table, includes a pipe extending up to a fluid swivel unit lying above the sea surface and protected from the sea, and a pipe connecting the rotatable portion of the fluid swivel to the loading arm. A tanker can be tightly held against the rotatable table device, as by the use of hawsers extending from the table device to the ship and pulled tightly so that a pair of fenders on the table device bear against the ship. The table device and ship then can pivot about the table support under the influence of winds, waves, and currents, so that only minimal loads are applied to the table support. During such movement of the tanker, LNG can be transferred between it and an underwater line, utilizing exposed and unsupported above-water conduits of minimal length.

The novel features of the invention are set forth with particularity in the appended claims. The invention will be best understood from the following description when read in conjunction with the accompanying drawings.

DESCRIPTION OF THE PREFERRED EMBODIMENTS

Figure 2:
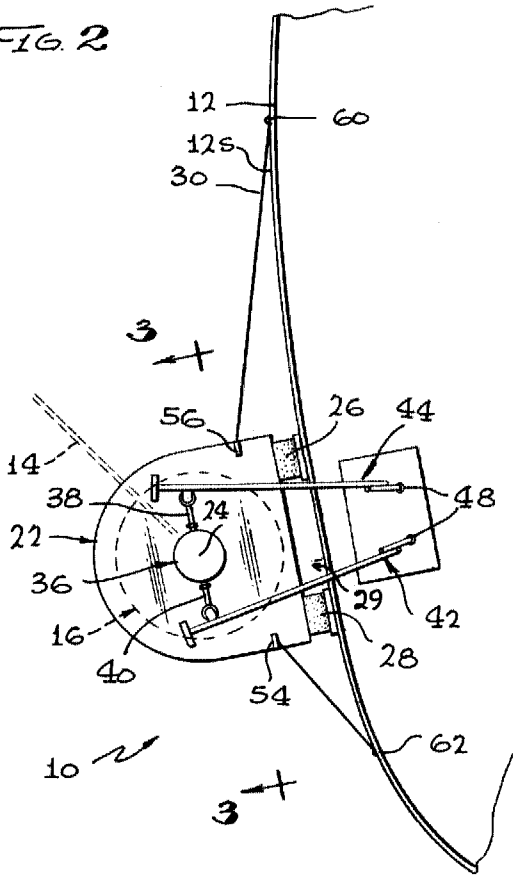
FIG. 2 is a partial plan view of the system of FIG. 1.
Figure 1:
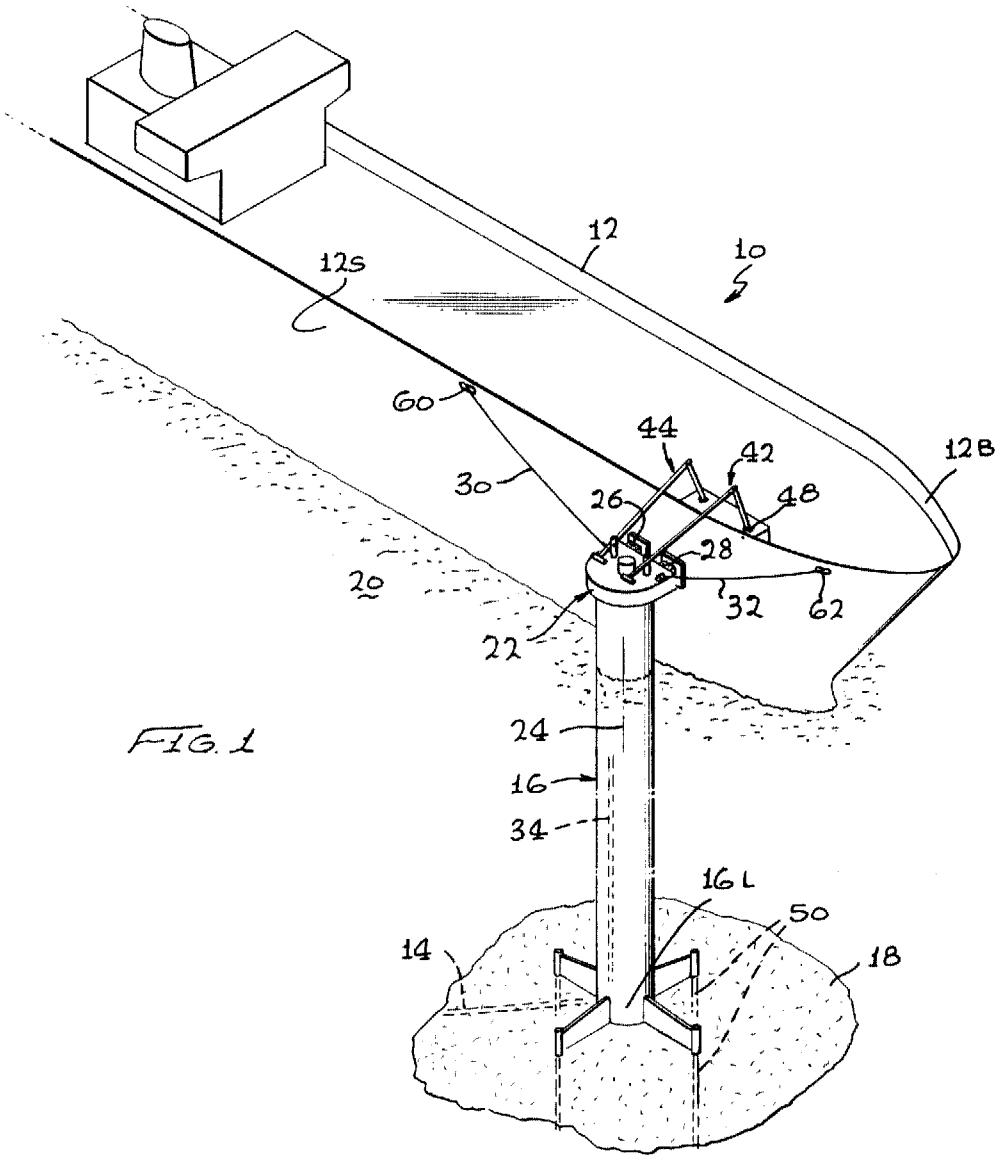
FIG. 1 is a perspective view of a mooring terminal constructed in accordance with one embodiment of the present invention, and shown with a tanker held to it.
Figure 3:
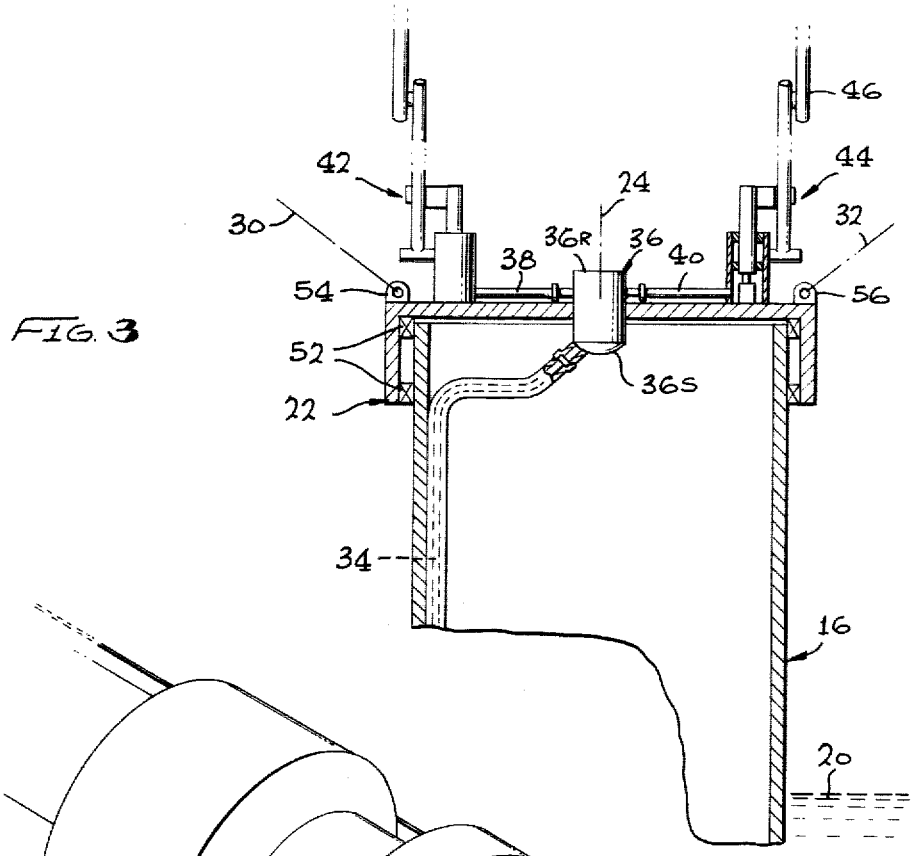
FIG. 3 is a view taken on the line 3—3 of FIG. 2.

FIGS. 1–3 show a mooring and cargo transfer system 10 for mooring a vessel such as a tanker 12 and transferring a supercooled liquified gas such as LNG (liquified natural gas) between an underwater pipeline 14, which may extend along the seabed, and the tanker. The system includes a table support 16 in the form of a rigid tower extending from the seabed 18 to the sea surface 20. The table support tower 16 supports a table device 22 in rotation about a substantially vertical axis 24. The table device or table 22 carries a pair of laterally spaced fenders 26, 28 on one side 29, that can bear directly against the side 12S of the tanker or ship at a location near the bow thereof. A pair of tension members, which can transfer tension loads and which may be rigid or flexible, such as hawsers 30, 32, extend between the table and the tanker. The hawsers are pulled taut to hold the table securely against the tanker side. The tanker can rotate with the table about the axis 24 into a position of least resistance to wind, waves, and current, to impose a minimal mooring load on the table support tower 16.

In the situation where LNG is transferred from the underwater line 14 to the tanker, the LNG fluid moves upwardly through a conduit 34 to a fluid swivel 36. The conduit 36 extends within the table support tower 16 to the stationary portion 36S (FIG. 3) of the fluid swivel 36. The table support helps isolate and insulate the pipe from sea water. A lateral conduit which connects the rotatable portion 36R of the swivel to the ship, includes a pair of pipes 38, 40, that extend from the rotatable portion 36R of the swivel unit to a pair of loading arm devices 42, 44. The loading arms are of a conventional type, such as the Chicksan loading arm, which includes an end portion 46 that can pivot about a plurality of axes with respect to the table 22 to reach a coupling 48 on the tanker.

While offshore terminals for the transfer of liquid such as oil, at ambient or higher temperatures, utilize many of the same principals as the terminal of the present invention, special considerations must be taken into account when LNG or other supercooled liquid is to be transferred. Conduits carrying LNG normally become coated with ice, and ordinary underwater fluid swivels will freeze and cease to allow pivoting. This is due not only to heat conduction, but also to leakage of LNG which is difficult to prevent due to the small size of the gas molecules. Flexible hoses also are not easily utilized with LNG because most hoses become hardened by the extreme cold, and normally only short lengths of special hoses can be utilized to carry LNG. Since LNG cannot be carried to a ship through flexible hoses lying in the water, an alternative is the use of primarily hard piping lying out of the water to extend between a terminal and the ship. Such piping is normally in the form of a loading arm which includes a long pipe that must be easily manipulated from a location near one end, and which may extend in a largely cantilevered manner from that location. Very long loading arms cannot be utilized because they become unwieldy, while shorter loading arms necessitate the tanker mooring close to the terminal, and require a design that avoids damage to the ship or terminal that could occur if the ship bumped into the terminal in heavy seas. The terminal also must be designed to permit free rotation of the ship under influence of wind, waves, and current, and facilitate the connection and disconnection of the ship from the terminal. The use of a table that bears directly against the side of a ship, and that can be held thereagainst by a pair of hawsers, provides secure mooring with free ship rotation, and with rapid connection and disconnection of the ship from the terminal, while enabling short loading arms to be utilized to carry the LNG between the table and ship.

The table support tower 16 can be constructed, as shown in FIG. 1, with the lower end 16L held by a group of piles 50 to the sea floor, so that the tower 16 does not tilt. This design is appropriate for shallow water situations, where a tower of moderate height can be utilized. Of course, the rigidly mounted table support tower can include several columns tied together instead of a single one. In much deeper water, it is possible to utilize a tilt joint for the tower, provided that special underwater fluid swivels or other means are provided to carry fluid past the tilt joint without freezing. As mentioned above, such specialized devices can be costly. As shown in FIG. 3, the fluid swivel 36 which permits rotation about the vertical axis 24, is preferably above the level of the sea at 20 even at high tide to avoid direct contact with the sea. The table 22 is rotatably mounted about the same vertical axis 24 by a pair of bearings 52. A pair of eyelets 54, 56 serve as hawser couplings for securely attaching the ends of hawsers to the table.

The transference of LNG to a tanker 12 can be accomplished by positioning the bow portion 12B of the tanker alongside the table 22, fastening the ends of aft and forward hawsers 30, 32 that extend from laterally spaced locations 60, 62 on the ship, to the eyelets 54, 56 on the table, and operating winches or the like on the ship to draw the hawsers 30, 32 tight. The pulling of the hawsers causes the ship to draw close to the table, until the fenders 26, 28 on the table press firmly against the side of the ship. The ship can be provided with wear plates against which the fenders will press, and the fenders can be provided with bearings at the ends to facilitate up and down movement of the ship. The provision of two laterally spaced fenders 26, 28 (or a single fender that has laterally spaced portions to contact spaced locations along the length of a ship) plus the use of two laterally spaced hawsers, helps to hold the ship and table at a constant orientation with respect to one another. The fact that the table engages a location near an end of the ship such as the bow (it could engage a stern portion instead), means that the ship easily turns to lie in the direction of least resistance to wind, waves and current to minimize mooring leads on the tower. It should be noted that it is possible to construct the table so that anyone of a plurality of sides can be coupled to a vessel, by providing pairs of fenders on other table sides, although this adds to the cost of the system. After the ship has been moored, the loading arms 42, 44, which are long enough to reach beyond the table, are pivoted so that their outer ends can be connected to fluid couplings on the ship, and valves (not shown) can be operated to begin the transfer of LNG to the tanker.

Figure 4:
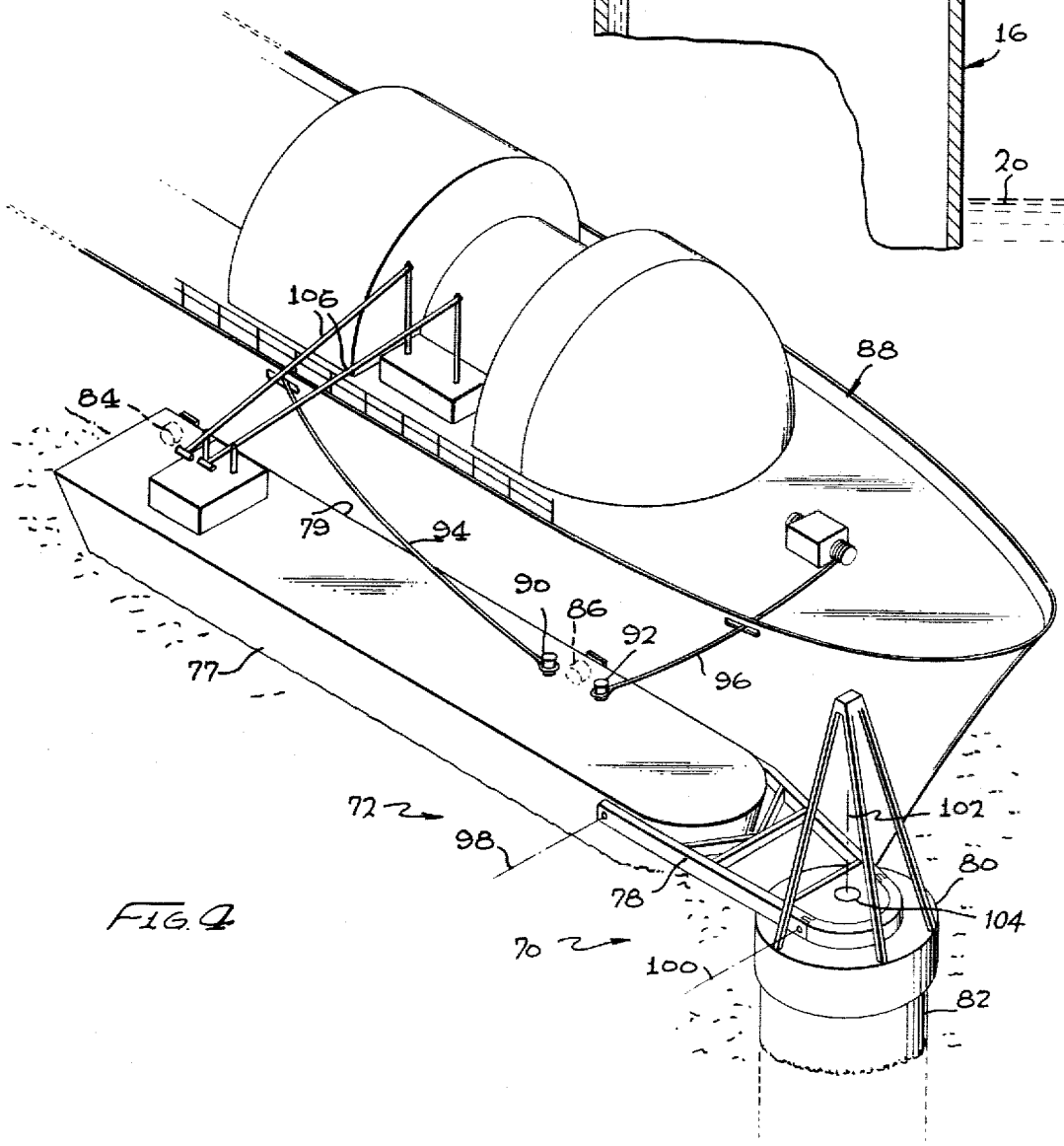
FIG. 4 is a partial perspective view of a mooring and cargo transfer system constructed in accordance with another embodiment.

FIG. 4 illustrates another mooring and cargo transfer system 70 which utilizes a different table device 72. The table device 72 includes a long barge 77 which is connected by a yoke 78 to a platform 80 that can rotate about a vertical axis on a rigid tower table support 82. The buoyant part or barge 77 has a ship-engaging side 79 which carries a pair of laterally spaced fenders 84, 86 that bear against the side of a tanker 88, while a pair of hawser connectors 90, 92 hold a pair of hawsers 94, 96 that are tied to the ship. The use of a pivoting yoke 78 which can pivot about horizontal axis 98, 100, permits the barge 77 to move up and down with the tanker without rubbing thereon. The axis of rotation 102 of the table device about the table holder 82, is located forward of the bow of the vessel, so that sideward forces on the vessel are not applied directly to the single anchor leg or tower 82, but instead provide a torque that causes barge rotation. The considerable length of the barge, which is more than twice its average width, enables the fender locations at 84, 86 to be widely spaced by more than the barge width. This facilitates the secure abutment of the barge with the vessel, and enables the fenders to be widely spaced from the axis of rotation 102 of the table device. Although a somewhat longer pipe connection is required between the swivel unit 104 and the loading arms 106, the piping that connects them is all above water, and easily supported and insulated, and therefore is subject only to moderate icing and can be easily maintained. It may be noted that while the system is especially useful for transferring a supercooled fluid such as LNG, it can be useful in the transfer of other fluids and especially difficult-to-transfer fluids such as ammonia where special care must be taken to avoid leakage.

Thus, that invention provides a mooring and cargo transfer system for transferring a difficult-to-transfer fluid and especially a cold fluid such as LNG between an undersea conduit and a vessel, which enables an easily manipulated, above-water conduit or primarily hard pipe to be utilized to transfer the fluid between a ship and terminal, and which enables rapid mooring and release of a vessel while applying a moderate mooring load to the terminal during the mooring, all in a relatively simple system. The system includes a table support that supports a table device in rotation about a substantially vertical axis, and with the table device having a fender for bearing directly against the side of a ship and a hawser coupling for holding at least one hawser or other tension member in tight extension between the table device and ship. The direct abutment of the table device with the ship enables one or more loading arms of only moderate length to be utilized to carry the cool fluid at a level above the sea surface from the table device to the ship.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A mooring and cargo transfer system for transferring a fluid between an undersea line and vessel, comprising:

a table support;

means for anchoring said support at a location over a sea floor;

a table device rotatably connected to said support about a substantially vertical axis, said table device having a fender means for bearing against a vessel, and also having coupling means for holding the table device to the vessel with the fender means bearing firmly against the hull of the vessel;

a fluid swivel having a rotatable portion rotatable about a primarily vertical axis with said table device, and a stationary portion coupled to the undersea conduit; and at least one loading arm mounted on said table device and connected to the rotatable portion of the fluid swivel, said arm having a length great enough to reach beyond the side of a vessel abutting said fender means, whereby the arm can connect to the vessel to carry fluid between the vessel and the undersea line.

2. The system described in claim 1 wherein:

said fender means includes a pair of widely laterally spaced fender portions at one side of said table device, for simultaneously bearing against the side of a ship to hold the ship at a substantially constant orientation with respect to the table device; and said coupling means of said table device includes a hawser coupling for connecting to a tension member that extends to the ship to hold the ship against the table device.

3. The system described in claim 2 including:

a ship lying alongside said table device and against said fender portions, and at least one taut hawser having opposite end portions tied respectively to said hawser coupling on said table device and said vessel to hold them together.

4. The system described in claim 1 wherein:

said table device includes a barge which is buoyant and which is spaced from said table support, and a yoke connecting the barge to the table support and pivotally coupled about a horizontal axis to at least one of them, said yoke being rotatable about a vertical axis with respect to said table support.

5. The system described in claim 4 wherein:

said barge has a length at least twice its average width and has a pair of fenders spaced along its length by more than the average barge width.

6. A system for transferring fluid between an underwater pipeline and a ship, comprising:

a base at the sea floor;

a tower having a lower and connected to the base and an upper end near the water surface;

a table device lying near the sea surface and rotatably connected to the upper end of said tower;

a fluid conduit which includes a fluid swivel lying substantially at the top of said tower, and having stationary and rotatable portions, a downward conduit having a top part connected to the stationary fluid swivel portion and a bottom part connected to the underwater pipeline, and a lateral conduit portion extending between the rotatable fluid swivel portion and the ship;

said table device having a ship-engaging side, a pair of laterally spaced fender portions located along said side and positioned to bear against spaced locations at the side of a ship, and having a pair of hawser couplings for holding hawsers that extend to a ship; and said lateral conduit portion including at least one loading arm mounted on said table device and long enough to reach beyond said ship-engaging side of said table device to reach and connect to a ship.

7. The system described in claim 6 wherein:

said table device includes a buoyant part lying near the tower and a yoke having one end rotatably coupled about a vertical axis to said tower and another end coupled to said buoyant part, and with opposite ends of the yoke being pivotal about horizontal axis with respect to said tower and buoyant part, said fender portion positioned on said buoyant part.

8. In a system for transferring liquified natural gas and other fluid between an underwater pipeline and a ship by an upward conduit that extends up from the pipeline to the stationary portion of a swivel unit near the sea surface that permits rotation about a vertical axis, and by a lateral conduit that extends from the rotatable portion of the swivel unit to the ship, the improvement comprising:

a table support extending from the sea floor to the sea surface;

a table of predetermined width lying at the sea surface; and means for supporting the table on the top portion of said table support in rotation about a substantially vertical axis with respect to said support;

said table having fender means for abutting the side of a ship, and said lateral conduit including at least one loading arm mounted on said table and being long enough to reach beyond said table to a ship when the fender means abuts the ship but not long enough to reach the ship when the fender means is further from the ship than about twice the width of the table device.

9. A method for mooring a ship and transferring a fluid between an underwater pipeline and the ship, comprising:

tying said ship tightly against a table device which is rotatable about a vertical axis on a table support that is anchored to the sea floor;

moving a loading arm on said table so it reaches beyond the table device and connects to the ship; and passing the fluid between the underwater pipeline and the stationary portion of a fluid swivel lying on said vertical axis, and between the rotatable portion of the fluid swivel and said loading arms.

10. The method described in claim 9 wherein:

said step by tying includes holding a pair of laterally spaced fenders on the table against a side of the ship at a location near but spaced from an end of the ship.

* * * * *